US006142088A

United States Patent [19]

Beyer

[11] Patent Number: 6,142,088

[45] Date of Patent: Nov. 7, 2000

[54] TUFTING NEEDLE

[75] Inventor: Walter Beyer, Eschweiler, Germany

[73] Assignee: Groz-Beckert KG, Germany

[21] Appl. No.: 09/101,365

[22] PCT Filed: Dec. 24, 1996

[86] PCT No.: PCT/DE96/02512

§ 371 Date: Nov. 13, 1998

§ 102(e) Date: Nov. 13, 1998

[87] PCT Pub. No.: WO97/25466

PCT Pub. Date: Jul. 17, 1997

[30] Foreign Application Priority Data

Jan. 8, 1996 [DE] Germany ..... 196 00 328

[51] Int. Cl.[7] ..... D05C 15/20

[52] U.S. Cl. ..... 112/222; 112/80.4

[58] Field of Search ..... 112/222, 80.01, 112/80.4, 80.45

[56] References Cited

U.S. PATENT DOCUMENTS 205,243 6/1878 Carey ..... 112/222

4,563,961 1/1986 Beyer et al. ..... 112/222

5,189,966 3/1993 Satterfield ..... 112/222 X 5,215,021 6/1993 Fuhrmann ..... 112/222

FOREIGN PATENT DOCUMENTS 905181 11/1960 United Kingdom ..... 112/222

*Primary Examiner*—Ismael Izaguirre

*Attorney, Agent, or Firm*—John C. Purdue; David C. Purdue

[57] ABSTRACT

A tufting needle is disclosed. The needle consists of a butt (3) and a shank (7). The butt can be integrally formed at least partially in a needle module (1), while the shank has a needle tip, provided with an eye (9), and a thread guide groove (8) on one side as well as a chamfer (10) at one edge of the side (11) which is located opposite the thread guide groove (8). A chamfer (10) is likewise provided at a second edge of the side (11) opposite the guide groove (8), and the tufting needle is symmetric relative to a plane centrally dividing the thread groove (8) and the side (11) opposite the guide groove (8).

1 Claim, 2 Drawing Sheets

TUFTING NEEDLE

BACKGROUND OF THE INVENTION

1. Field of the Invention

The invention relates to a tufting needle, consisting of a butt, which is capable of being integrally formed at least partially in a needle module, and of a shank, which has a needle tip, provided with an eye, and a thread guide groove on one side as well as a chamfer at one edge of the looper side located opposite the thread guide groove.

A relatively large number of tufting needles of this type are integrally formed in needle modules which, in turn, are fixed to a needle bar.

The needle modules have a bearing face which may be provided with a projecting strip. The strip may be designed as a moulded strip which engages in a groove of the needle bar. It may also be designed as a bearing strip which bears on the lower edge of the needle bar when the needle modules are fastened to the latter.

A needle module, the two sides of which are designed as a bearing face, is already known from WO 95/23 253. A bearing strip is integrally formed correspondingly on both bearing faces.

2. Background Art

German utility model 295 06 819.1 shows a needle module, likewise with two bearing faces and strips which are integrally formed on both bearing faces and which engage into a groove of the needle bar. In the above mentioned variants, therefore, the module can also be inserted in a position rotated through 180°. The number of tools required can be halved in this way. There are the following technical reasons for this:

For needle modules with only one bearing face, it is necessary to keep different variants ready, depending on the intended use. This is attributable to the following cause:

When the needle module is in operation, after a basic fabric has been pricked a looper engages between the side face of the needle and the thread on one side of a tufting needle in each case and retains the thread. Loops are thereby formed when the needles are moved upwards again.

In order to minimize the wear during the interaction of loopers and needles, the needles are chamfered on this side face at a definite angle to the direction of movement of the loopers.

Depending on how the tufting machine is designed, then, appropriate module variants have to be manufactured according to whether the loopers, when they move, engage on the left or right of the needles and whether the loopers are arranged on the left or right of the needle bar, as seen in the longitudinal direction of the latter. In the case described, there are four possibilities, that is to say four different modules have to be kept ready.

By means of the modules described in the introduction and capable of being inserted in two positions, it is possible to halve the number of variants required, since one module, by being rotated, is suitable both for loopers arranged on the left of the needle bar and for those arranged on the right of the latter. In this case, two variants remain for loopers engaging in each case on the left or right side faces of the needles.

SUMMARY OF THE INVENTION

The object on which the invention is based is to provide further simplifications in the system of tufting needles and needle modules, so that the needle modules can be used for all looper design configurations.

The object is achieved, according to the invention, in that a chamfer is likewise provided at the second edge of the looper side.

In a way preferred according to the invention, the tufting needle may be designed symmetrically relative to a plane centrally dividing the thread guide groove and the looper side.

The invention will be explained in more detail with reference to an exemplary embodiment.

DESCRIPTION OF THE PREFERRED EMBODIMENTS

Figure 1:
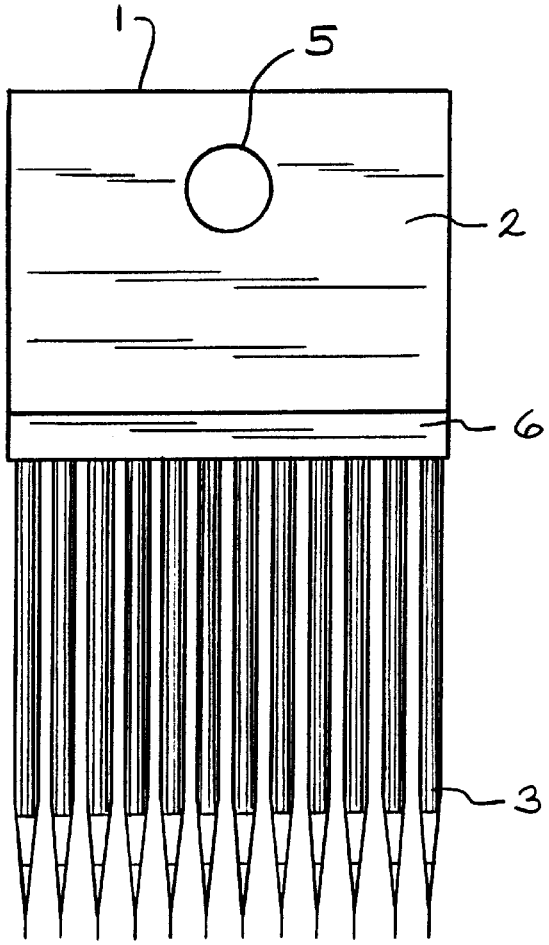
FIG. 1 shows a front view of a needle module with the tufting needles according to the invention.

FIG. 1 shows a needle module 1, consisting of a basic body 2 and of the tufting needles 3 which are integrally formed with part of their butt 4 in the basic body 2. For fastening to a needle bar, the basic body 2 is provided with a bore 5. As is evident from FIG. 2, a bearing strip 6 is integrally formed on each of the two sides of the basic body 2. When a tufting machine is in operation, the needle module 1 then bears with one of the bearing strips 6 on the lower edge of a needle bar.

Figure 2:
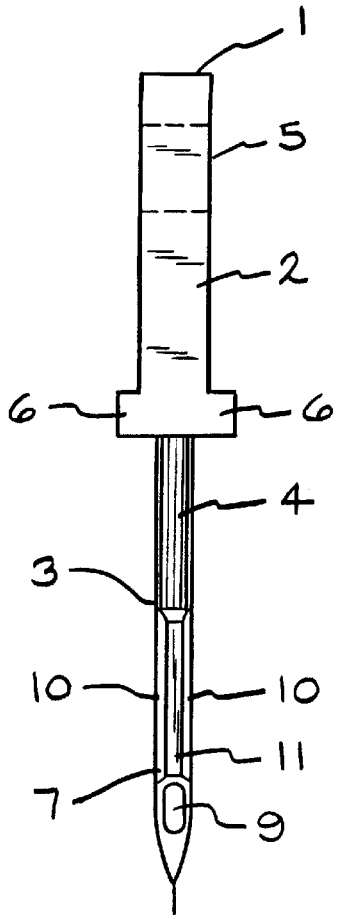
FIG. 2 shows a side view of a needle module according to FIG. 1.
Figure 3:
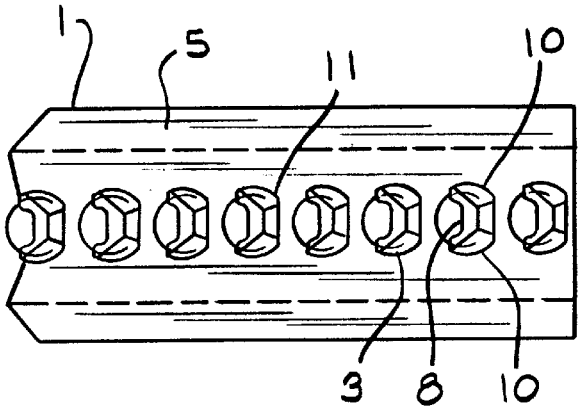
FIG. 3 shows an enlarged bottom view of a module with the tufting needles according to the invention.

The shank 7 of the tufting needles 3 has a thread guide groove 8 for thread guidance, as becomes clear in the view according to FIG. 3. It can be seen from the view of FIG. 2 that the thread guide groove 8 is located on the rear side of the needles 3. An eye 9, through which the thread is led, is located at the tip of the needles 3.

Chamfers 10 are located on the two end faces of the needles 3 towards the front side face of the looper side 11 of the needles 3, the said side face lying in the paper plane, as seen in FIG. 2. The needle module 1 can therefore be used for tufting machines, of which the loopers, not shown here, are moved, in relation to a needle module position, as shown in FIG. 2, in the direction from the left towards the needle module 1 and past the needles on the right or in a direction from the right towards the needle module 1 and past the needles on the left. In the first case, the loopers engage between the needles, moved up and down on the left of them, and the threads and, in the other case, the said loopers engage between the needles, moved up and down on the right of them, and the threads.

When the needle module 1 is rotated on the needle bar, the needle module is suitable for tufting machines, the loopers of which are moved from the left towards the needle bar and past the needles on the left or from the right towards the needle bar and past the needles on the right.

Figure 4:
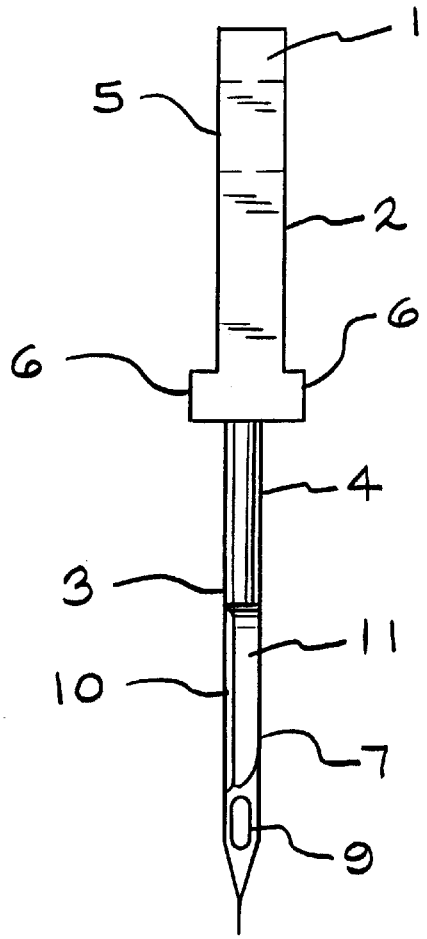
FIG. 4 (PRIOR ART)
FIG. 4 shows the side view of a needle module with tufting needles known hitherto.
Figure 5:
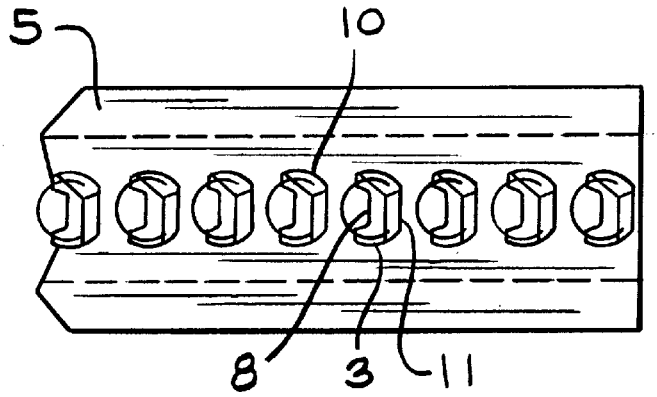
FIG. 5 (PRIOR ART)
FIG. 5 shows an enlarged bottom view of the needle module according to FIG. 4.

FIGS. 4 and 5 show a needle module 1 with needles 3, as known hitherto. The needles 3 are provided with a chamfer 10 at only one edge. They are therefore suitable only for tufting machines, the loopers of which are moved from the left towards the needle module, as seen in FIG. 4, and grasp the thread on the right of the needles.

When the needle module 1 is rotated through 180°, the needle module 1 is suitable for tufting machines, the loopers of which, in a similar way to the view in FIG. 5, but now with a needle module rotated through 180°, are moved from the right towards the needle module and grasp the thread on the right of the needles.

For tufting machines, the loopers of which grasp the thread on the left of the needles, as seen from the direction of movement of the looper, it would be necessary to have a needle module, the needles of which are chamfered at the opposite edge.

A needle module equipped with the needles according to the invention, insofar, moreover, as it is designed so that it can also be used in a position rotated through 180°, can be used for all variants of tufting machines.

I claim:

1. Tufting needle, consisting of a butt (3), which is capable of being integrally formed at least partially in a needle module (1), and of a shank (7), which has a needle tip, provided with an eye (9), and a thread guide groove (8) on one side as well as a chamfer (10) at one edge of the side (11) located opposite the thread guide groove (8), characterized in that a chamfer (10) is likewise provided at a second edge of the side (11) opposite the guide groove (8), and in that the tufting needle is symmetric relative to a plane centrally dividing the thread guide groove (8) and the side (11) opposite the guide groove (8).

* * * * *